US011214345B2

(12) United States Patent
Gai et al.

(10) Patent No.: US 11,214,345 B2
(45) Date of Patent: Jan. 4, 2022

(54) PROPULSION ASSEMBLY AND BOAT COMBINATION, BOAT PROPULSION METHOD, AND BOAT PROPULSION ASSEMBLY

(71) Applicant: Ultraflex S.p.A., Casella (IT)

(72) Inventors: Marcella Gai, Busalla (IT); Marco Campagna, Busalla (IT)

( * ) Notice: Subject to any disclaimer, the term of this patent is extended or adjusted under 35 U.S.C. 154(b) by 0 days.

(21) Appl. No.: 16/659,953

(22) Filed: Oct. 22, 2019

(65) Prior Publication Data

US 2020/0130799 A1 Apr. 30, 2020

(30) Foreign Application Priority Data

Oct. 22, 2018 (IT) ..... 102018000009660

(51) Int. Cl.
*B63H 20/10* (2006.01)
*B63H 20/02* (2006.01)

(52) U.S. Cl.
CPC ..... *B63H 20/106* (2013.01); *B63H 20/02* (2013.01)

(58) Field of Classification Search
CPC ..... B63H 20/106; B63H 20/02; B63H 20/06; B63H 20/08
See application file for complete search history.

(56) References Cited

U.S. PATENT DOCUMENTS 2,808,218 A * 10/1957 Steller ..... B63H 20/14 248/641
4,239,172 A * 12/1980 Spitzmesser ..... B63H 20/06 248/641
5,186,666 A 2/1993 Stanley
6,132,271 A * 10/2000 Hebert ..... B63H 20/06 440/53
10,322,784 B2 * 6/2019 Gai ..... B63H 20/06
2017/0320554 A1 11/2017 Gai

FOREIGN PATENT DOCUMENTS

WO 9922989 5/1999

OTHER PUBLICATIONS

Ministry of Economic Development (Italy), Search Report, dated May 28, 2019 See pages in English.

* cited by examiner

*Primary Examiner* — Anthony D Wiest
(74) *Attorney, Agent, or Firm* — Themis Law

(57) ABSTRACT

Combination of boat and outboard engine, in which at least one outboard engine is fastened to the transom of the boat in a prearranged position, the engine being mounted to translate along a path with at least one motion component having a vertical orientation in a direction away from or close to the waterline of the boat, that is, of smaller or greater propeller draft, and a motion component having a horizontal or longitudinal orientation in a direction away from or close to the transom of the boat.

12 Claims, 5 Drawing Sheets

PROPULSION ASSEMBLY AND BOAT COMBINATION, BOAT PROPULSION METHOD, AND BOAT PROPULSION ASSEMBLY

FIELD OF THE INVENTION

Object of the present invention is a combination of a propulsion assembly and boat, a propulsion method of a boat and propulsion assembly for a boat.

Purpose of the present invention is to improve the efficiency of marine engines, especially outboard, so that to allow the user to optimize the thrust effect with respect to the different speed and floating conditions and to the different shapes of the hull.

BACKGROUND OF THE INVENTION

Currently, the movement of outboard engines involves the classic steering rotation, an oscillation of the engine around a horizontal axis substantially parallel to the transverse axis of the boat, so-named "trim" movement, and a translation along a vertical direction along a vertical axis or comprised in the vertical plane and tilted in the direction of the bow or stern of the boat.

The trim of the engines determines a variation in the orientation of the propellers which modify the direction of the thrust force by orienting such force more downwards or upwards.

The vertical translation, obtained thanks to motorized sleds named jack-plates which are interposed between the transom of the boat and the engine, determine the position of the propellers with respect to the surface of the water, i.e. their degree of draught and also the position of the propellers with respect to the lower edge of the transom.

There is a limit to the maximum vertical range that can be obtained with the jack-plates. Such limit is imposed by the need to ensure that the propeller is always wet by the water leaving the keel in order to avoid cavitation phenomena.

On the other hand, since the water flow has a substantially parabolic pattern with concavity facing downwards and vertex arranged at a certain distance from the transom, as shown in FIG. 2, the quantity of water wetting the propeller is not uniform and strongly depends on the distance of the engine from the transom. This involves a non-optimal adjustment of the vertical position of the engines.

Systems for translating the engines according to at least two different directions with respect to the transom are known, for example in the U.S. Pat. No. 5,186,666 wherein Stanley Thomas et al describe an articulated apparatus for moving an outboard engine of a boat by means of mounting elements, part of said mounting elements being in a plane of said boat and part of said mounting elements being located in a plane of said outboard engine and spaced from said plane of the boat, and said mounting elements being able to be mutually positioned by means of a set of actuators able to move the mounting element in the plane of the outboard engine, thus allowing the angular orientation of the engine, the vertical translation of the engine and/or the distance of the engine from said plane of the boat.

The device described in U.S. Pat. No. 5,186,666 thus claims the ability to move the engine in the various directions by means of a plurality of hydraulic or pneumatic actuators, whose combined and reciprocally coordinated activation allows to actuate the displacement, translational and angular, of the engine with respect to the boat, following the variation of the distance between the two fastening members with which the single actuator is made cooperative by means of appropriate fulcrums, respectively the plane's side of the boat and the plane's side of the engine.

The group of elements of the fastening system described in U.S. Pat. No. 5,186,666, which, as mentioned, uses actuators that vary the distance between said fastening fulcrums, involves a considerable complication both of initial calibration and of control and command, as well as an ensured weakening of the engine's suspension system.

SUMMARY OF THE INVENTION

Applicant has found that similar benefits of optimizing the position of the engine or of two or more engines can be obtained by means of a purely mechanical device which, consisting of simple, inexpensive and easy to implement elements, is able to optimize the use of the propulsive thrust of one or more engines without however introducing undesired implementation complications.

Object of the present invention is to optimize the propulsive thrust of a boat while allowing to position the outboard engine or engines, i.e. the corresponding propellers, in a position with respect to the hull, in particular at the keel thereof, and at the surface of the water such as to maximize the performance of the boat according to the needs of the speed selected and to the maneuvers to carry out.

The invention achieves the objective with a combination of a boat and outboard engine, wherein at least one outboard engine is fastened to the transom of said boat at a prearranged position, said engine being mounted so that to translate along a path with at least one motion component having a vertical orientation in a direction away from or close to the waterline of the boat, i.e. of smaller or greater propeller draft, and a motion component having a horizontal or longitudinal orientation in a direction away from or close to the transom of the boat.

In the present description and claims, the term vertical translation or vertical component of translation or displacement refers to a displacement in a direction perpendicular to the floating plane of reference of the boat.

The term horizontal translation or horizontal component of translation or of displacement refers to a displacement in a direction parallel to the longitudinal axis of the boat, i.e. perpendicular to the main section of the boat.

Due to this detail, also by considerably decreasing the propeller draft, the engine does not lose pressure because it is positioned at a certain distance from the transom in the zone in which the flow of water reaches a higher level.

In an embodiment, the engine is translated along a direction belonging to a plane perpendicular to the main section or parallel to a sectional longitudinal plane of the hull of the boat.

Advantageously, the translation of the engine occurs along a straight displacement path so that a translation away from the transom of the engine is combined with a vertical translation in direction of smaller propeller draft.

According to a particularly advantageous embodiment, the displacement in a direction away from the transom is gradual and increasing on the basis of the increase of the vertical displacement in the direction of smaller propeller draft.

The translation of the engine is driven, for example, by fastening devices to fasten the engine to the transom with displacement actuators of the mechanical, electric, hydraulic, electro-hydraulic, electromechanical, magnetic type.

The fastening devices to fasten the engine to the transom can advantageously comprise a couple of plates, of which one is fixed and one is movable, the plates acting like a sled one on the other, the movable plate sliding on the fixed plate along a plane parallel to a sectional longitudinal plane of the hull or perpendicular to the main section of the boat.

According to an embodiment, the fastening system to fasten the engine to the transom is constituted by a four-bar linkage or articulated polygon whose arms are of invariable length.

The control of the displacement of the engine is advantageously entrusted to a control unit configured to drive the displacement actuators so that to translate the engine in a direction away from the transom when said engine is translated vertically in a direction away from the waterline surface, i.e. of smaller propeller draft.

According to a further aspect, the invention concerns a method of governing a boat, comprising one, two or more outboard engines, the method providing the displacement of at least one of said engines along a path with at least one motion component having a vertical orientation in a direction away from or close to the waterline of the boat and a motion component having a horizontal or longitudinal orientation in a direction away from or close to the transom of the boat.

According to an embodiment, the displacement of the engine or engines occurs on a plane perpendicular to the main section or parallel to the longitudinal symmetry plane of the boat, by combining two linear translations along two directions that are not parallel to one another, preferably perpendicular to one another, for example one being a translation along a direction parallel to the longitudinal axis of the hull and the other one being a translation along a vertical direction.

Advantageously, the translation on the plane perpendicular to the main section or parallel to the symmetry plane, i.e. perpendicular to the transom or to one of its tangents, occurs along a path corresponding to a straight line.

According to a particularly advantageous embodiment, the displacement of the engine or engines in a direction away from the transom is gradual and increasing on the basis of the increase of the vertical displacement in the direction of smaller propeller draft.

The displacement of the engine or engines can be provided in combination with the steering rotation of the engine or engines and/or with a trim inclination of the engine or engines and/or with a translation towards a broadside of the hull of the engine or engines.

According to a further aspect, the invention concerns a propulsion assembly for a boat, comprising at least one outboard engine or two or more outboard engines, fastening devices to fasten the outboard engine or engines and which allow the displacements of the outboard engine or engines along predefined paths thanks to displacement actuators and wherein a drive system to drive the activating actuators of said devices is provided. The control system provides at least one drive member operable by the user and at least one control unit adapted to receive the drive signals generated by the drive member and to transform said signals into power signals adapted to supply the actuators correspondingly to said signals generated by the drive members. The control unit is advantageously programmed to drive the displacement actuators so that to translate the engine in a direction away from the transom whenever said engine is translated vertically in a direction away from the waterline surface, i.e. of smaller propeller draft.

According to a particularly advantageous embodiment, the control unit is programmed to drive the displacement actuators so that to translate the engine in a direction away from the transom, gradually and increasingly on the basis of the increase of the vertical movement in the direction of smaller propeller draft.

BRIEF DESCRIPTION OF THE DRAWINGS

These and other characteristics and advantages of the present invention will be clearer from the following description of some exemplary embodiments depicted in the attached drawings wherein.

DETAILED DESCRIPTION OF EMBODIMENTS OF THE INVENTION

Figure 1:
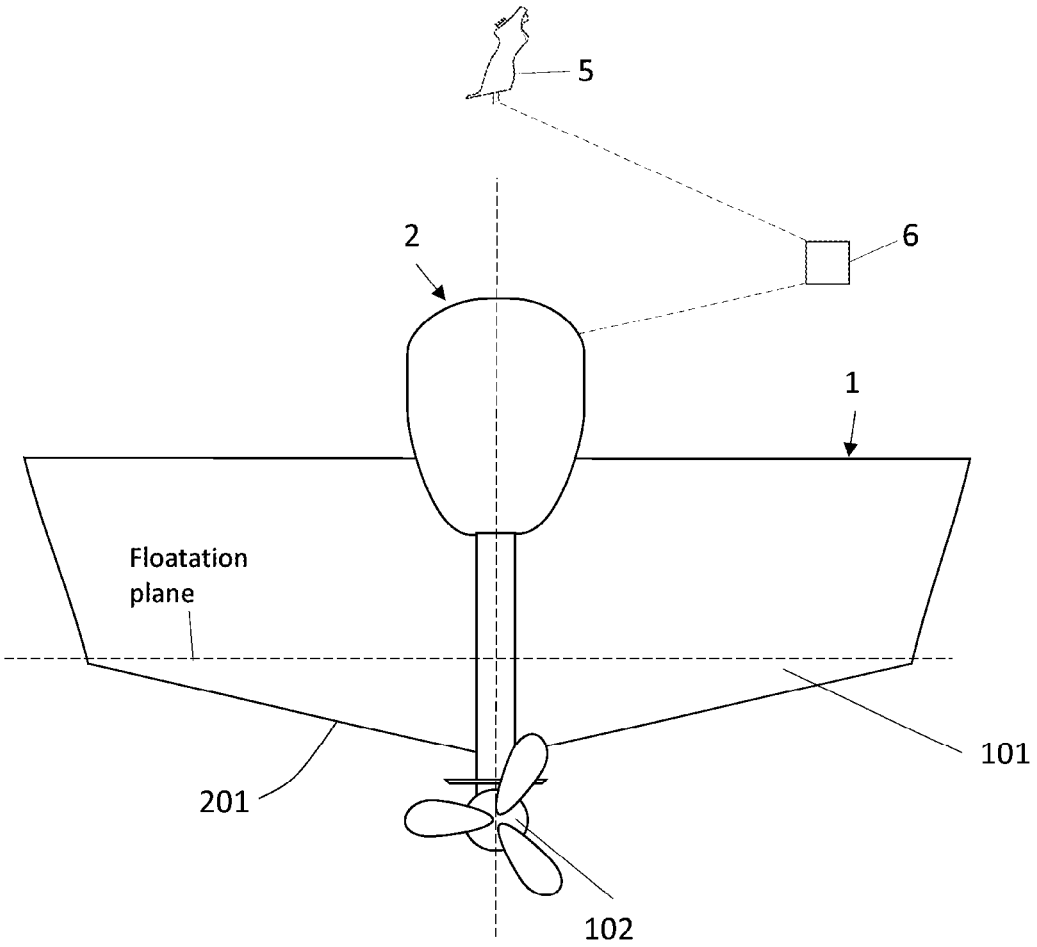
FIG. 1 schematically shows a boat provided with an outboard engine with the waterline denoted by the dotted line.

With reference to FIG. 1, a boat comprises a hull 1 with a transom 101. An outboard engine 2 is fastened to the transom 101 in a central position. The engine 2 is considered mounted so that to be able to carry out all possible displacements with respect to the transom currently known at the state of the art and, in particular, the steering rotation, trim inclination and vertical translation.

It should be noted that also when not expressly stated by the present description, each displacement of one or more engines can further be combined with one or more of the aforesaid displacements known at the state of the art and, in particular, always with a steering rotation of the engine or engines and optionally with one trim displacement.

In its simplest embodiment, the invention provides that, in addition to the steering rotation of the engine, the engine is further translatable along a direction with at least one motion component having a vertical orientation in a direction away from or close to the waterline of the boat, i.e. of smaller or greater propeller draft, and a motion component having a horizontal or longitudinal orientation in a direction away from or close to the transom of the boat.

Figure 5:
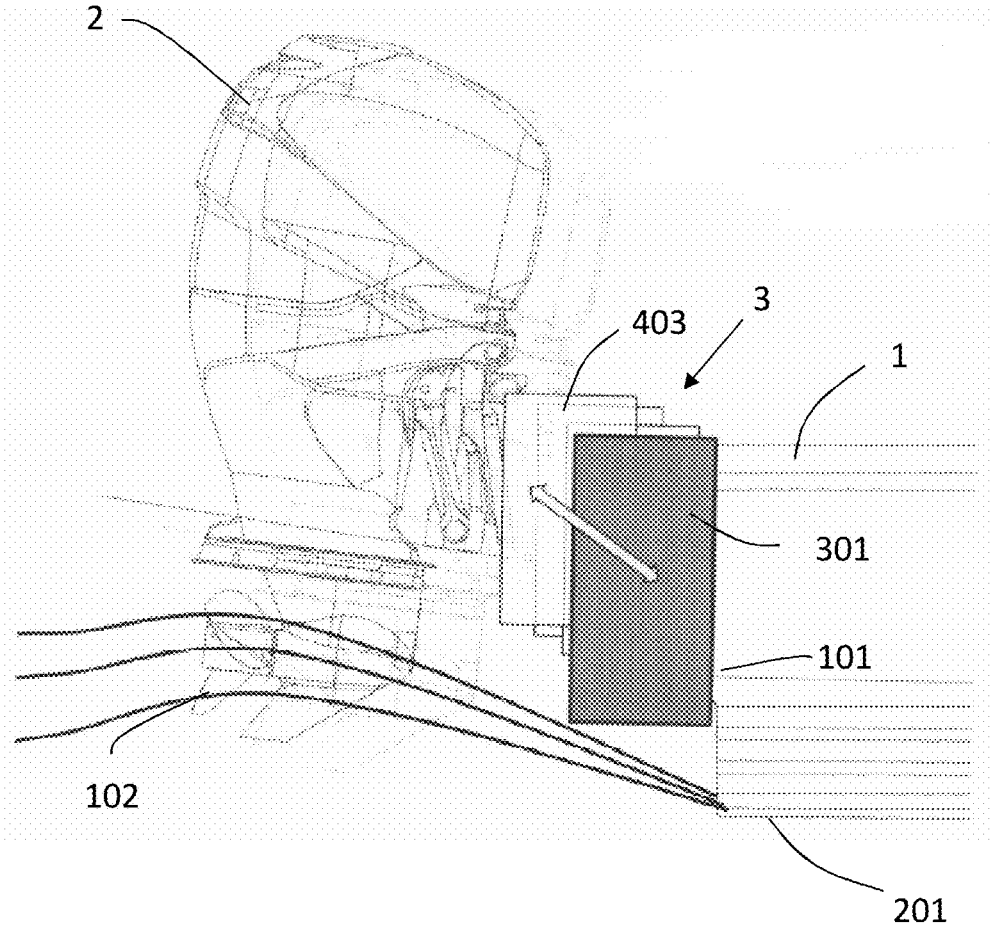
FIG. 5 schematically shows a side view of a boat provided with a plate-like fastening device adapted to allow the translation of the engine in an oblique direction belonging to a plane parallel to the longitudinal symmetry plane of the boat.

An embodiment provides that the engine or engines can be displaced relatively to the transom along a vertical plane parallel to a sectional longitudinal plane of the hull of the boat, as shown in FIG. 5.

The displacement in said plane can occur by combining two linear translations along to two directions that are not parallel to one another, preferably perpendicular, for example a longitudinal and a vertical translation.

In particular, one of the two translations, i.e. the longitudinal one, is along an axis parallel to the waterline and the other one being along an axis perpendicular to the waterline.

The term waterline means the substantially horizontal plane containing the theoretical waterline of the project of the boat.

The two translations along two directions perpendicular to one another can be actuated thanks to a combination of translation sleds of which a first sled is mounted on sliding guides along a supporting plate 301 so that to translate along a first of the two translation directions and a second sled is mounted on the first sled by means of guides of relative translation with respect to said first sled, which are oriented so that to allow the translation of said second sled in the second translation direction, while the engine is mounted on a movable plate 403 integral with the second sled and the supporting plate 301 is fastened to the transom 101.

Each of the sleds is slidingly driven by means of an actuator which can be of any type and interfaced with a control unit (identified with reference number 6 in FIG. 1) advantageously configured to drive the displacement actuators so that to translate the engine in a direction away from the transom when said engine is translated vertically in a direction away from the waterline surface, i.e. of smaller propeller draft.

Figure 6:
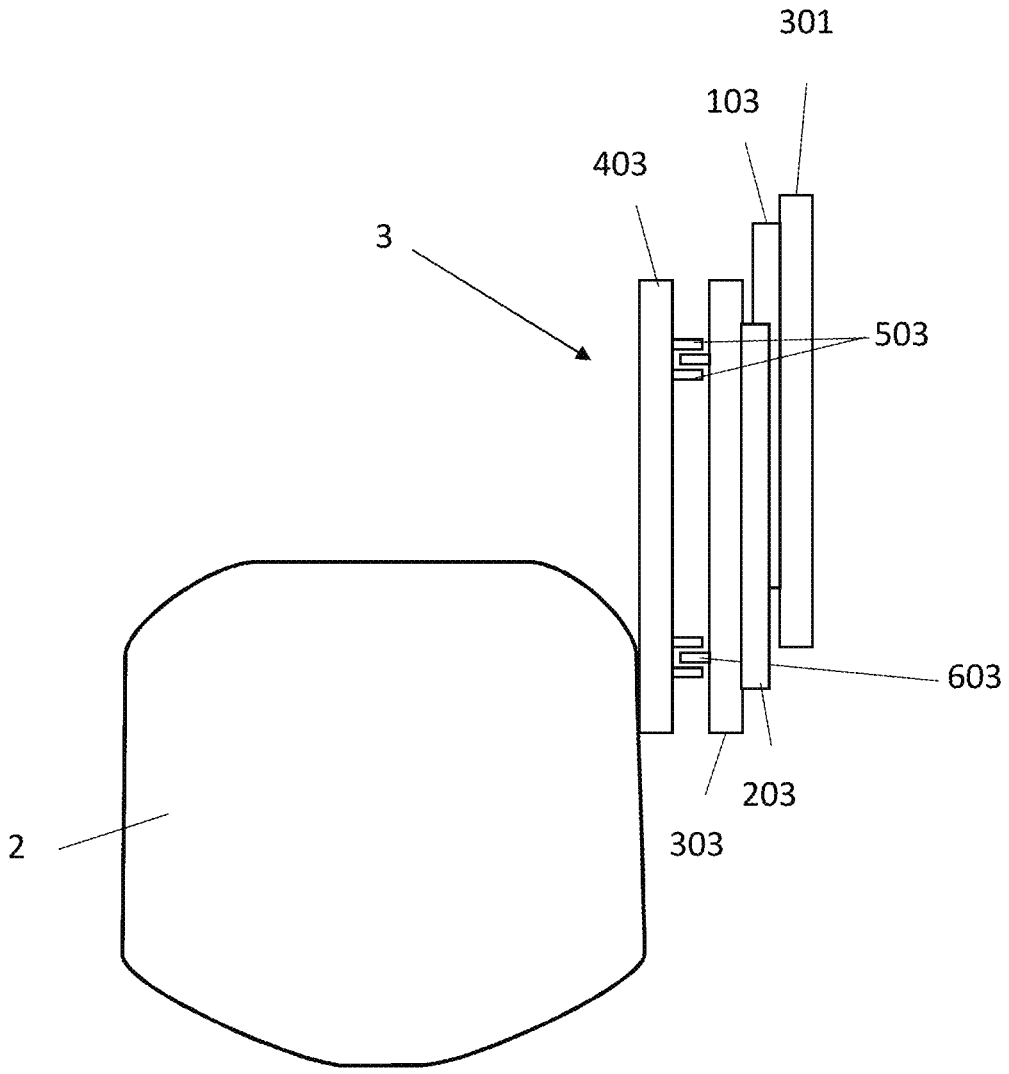
FIG. 6 schematically shows a plan view of the fastening device of the preceding figure.

FIG. 6 schematically shows a motorized-sled fastening device that can be used to achieve the translations of the engine or engines according to the invention.

The device, denoted by the reference 3, provides a supporting plate 403 for supporting the engine 2 which has, on the side facing outwardly, a couple of guides formed by vertical ribs 503 spaced from one another so that to form a sliding groove for a sliding block 603 integral with a second plate 303 constituting a further sliding sled.

The guides are oriented in a direction perpendicular to the waterline and the supporting plate 403 moves with respect to the intermediate sled 303 in said upwards and downwards direction. The intermediate sled 303 in turn bears a couple of guides 203 substantially similar to guides 503. The guides 203 are oriented in a direction parallel to a sectional longitudinal plane, i.e. in a direction perpendicular to the guides 503, and respective sliding skates 103, which are integral with a further plate 301 fastened to the transom, slide therein.

Thanks to this construction, the device 3 allows a displacement of the engine both in longitudinal and vertical direction so that to move it away from the transom when it is raised upwards, thus increasing the water pressure.

Figure 2:
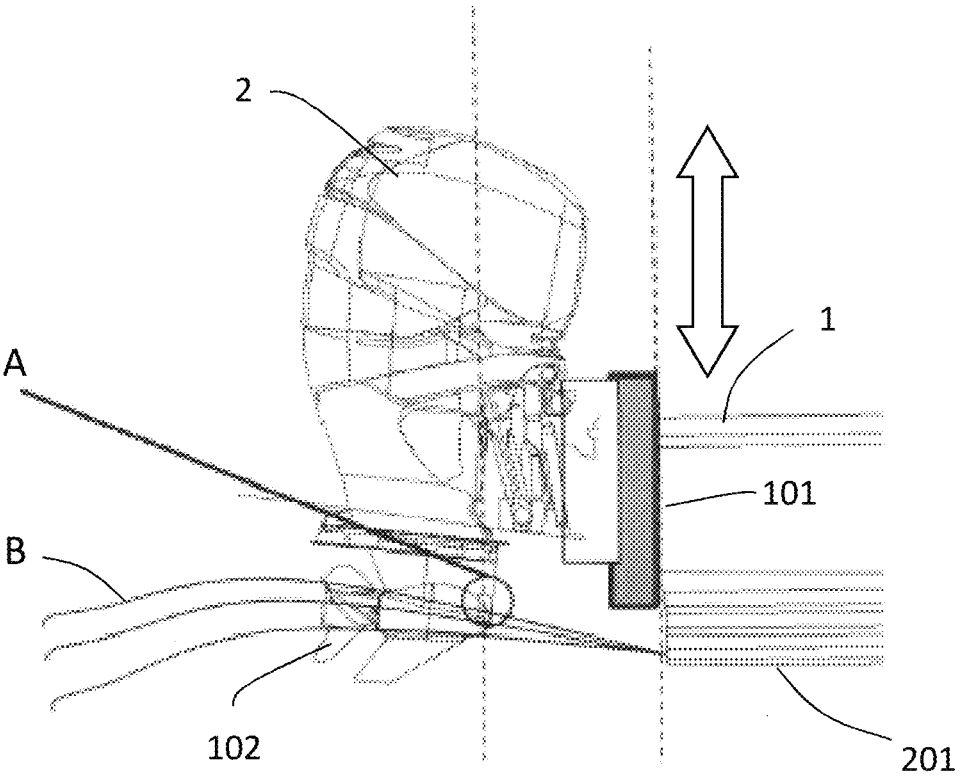
FIG. 2 schematically shows a side view of a boat provided with an engine that can translate vertically, thanks to the use of so-named jack-plates of the traditional type.

As shown in FIG. 2, the water flow leaving the keel 201 of a boat in fact has a substantially parabolic pattern with concavity facing downwards and vertex arranged at a certain distance from the transom 101.

By vertically raising the engine with the traditional jack-plates, the maximum height that can be reached before having a loss of pressure occurs when the point denoted by A in the figure reaches the last fluid fillet B and the propeller 102 is partially not wet. The cavitation begins beyond this point.

Figure 3:
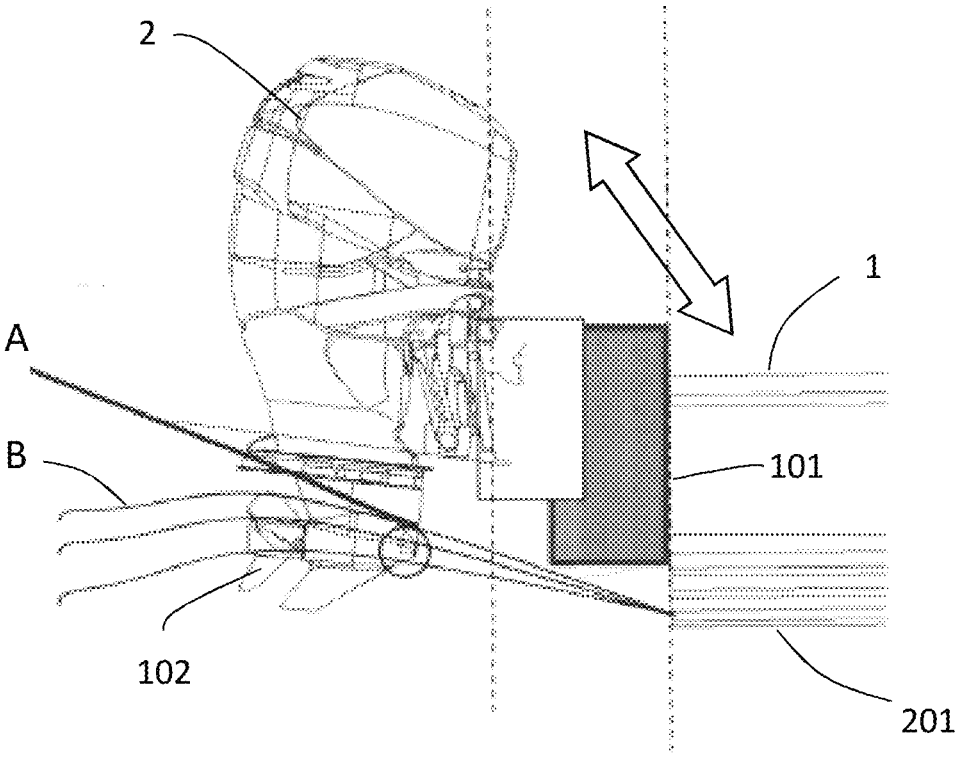
FIG. 3 schematically shows a side view of a boat according to an embodiment of the invention, wherein the engine can translate both vertically and longitudinally and anyhow along two tilted directions in a plane parallel to the longitudinal symmetry plane of the boat.

If the engine, in addition to being translated upwards, is also displaced backwards, i.e. in a direction away from the transom as shown in FIG. 3, at the same height of the engine, the point A is well under the last fluid fillet B with the propeller 102 completely immersed since located in the zone wherein the water flow has a maximum. This provides the ability to further raise the engine without losing pressure.

Figure 4:
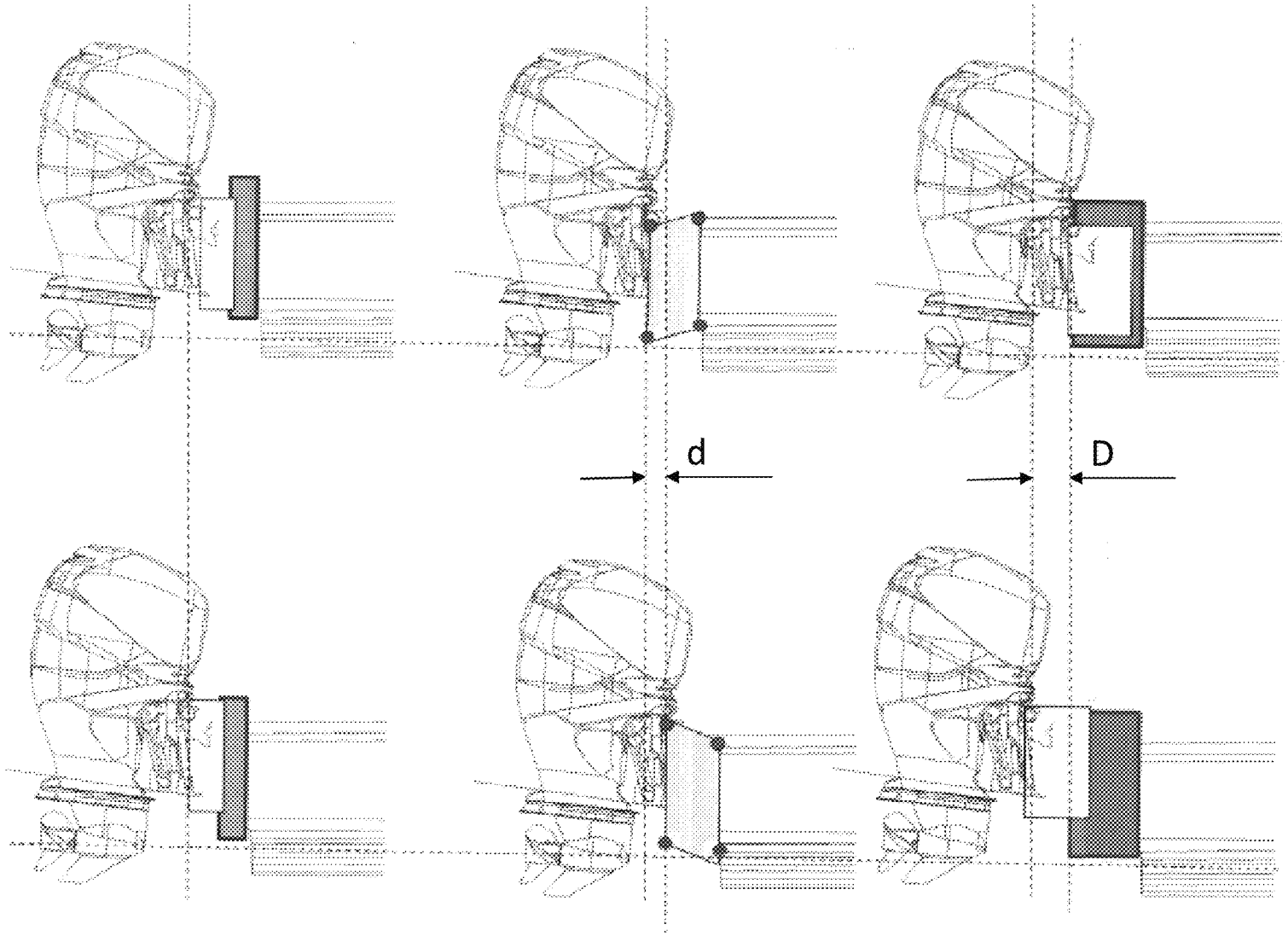
FIG. 4 schematically shows the position assumed by an engine with respect to the transom in the configuration of maximum (top) and minimum (bottom) propeller draft limit with reference to a configuration with traditional jack-plates (left), bracket holder with a four-bar linkage configuration (middle) and with a fastening device according to the invention (right).

The effect is still more evident when observing FIG. 4. Three engines in the same draft situation are shown in the upper part. The top left figure relates to a jack-plates system of the traditional type, i.e. with adjustment only along the vertical direction. The central figure is related to a fastening by means of a bracket holder with a four-bar linkage configuration. The top right figure instead relates to a fastening according to the invention and which allows the engine to translate in a sectional longitudinal plane of the boat along an oblique direction, i.e. along a straight line with both vertical and horizontal components.

The figures below show the draft limit position of the propellers following an upwards engine travel for each configuration. The traditional jack-plate rigidly translates the engine upwards, while keeping the distance from the transom constant. The bracket holder makes the engine carry out a movement along an arc of a circle with an initial moving away from the transom and a successive moving closer again when the rectangular configuration is exceeded, with an overall moving closer to the transom of the quantity denoted by d. In the present invention, the engine translates upwards concurrently with a movement away from the transom to place itself at a distance D therefrom. The result is that the maximum height reachable before the cavitation is minimum with a bracket holder, intermediate with a traditional jack-plate and maximum in the present invention.

The invention lends to numerous embodiment variants. For example, it is possible to provide any mechanism for supporting the engines which allows their displacement relatively to the transom along different axes of translation and rotation. The configuration of these mechanisms is also of any type as along as it is possible to operate a translation away from or close to the transom concurrently with a vertical translation.

Similarly, also the drive members of the displacement of the engine or engines can be of any type, such as for example a Joystick (identified with reference number 5 in FIG. 1) or a button or a combination thereof. All without departing from the guiding principle afore described and claimed hereinbelow.

The invention claimed is:

1. A combination of a boat and outboard engine, comprising:

an outboard engine fastened to a transom of said boat in a prearranged position, wherein said outboard engine is mounted so as to translate along an oblique path having, a first motion component of vertical orientation in a direction away from or in proximity to a waterline of the boat, so as to have a smaller or greater propeller draft, and a second motion component of horizontal or longitudinal orientation in a direction away from or in proximity to the transom of the boat, said first and said second motion component being combined to produce the oblique path, wherein a translation of said outboard engine along said oblique path is driven by fastening devices that fasten said outboard engine to said transom, and wherein said fastening devices comprise a plurality of plates, one of the plates being fixed to the transom and at least one of the plates being movable, the plates being disposed to slide on one another, the at least one movable plate sliding on the fixed plate along a plane parallel to a sectional longitudinal plane of the boat or perpendicular to the sectional longitudinal plane of the boat.

2. The combination according to claim 1, wherein the translation of the outboard engine occurs along a straight oblique path, so that the translation away from the transom of the outboard engine is combined with a vertical translation toward the smaller propeller draft.

3. The combination according to claim 1, wherein a displacement in the oblique direction away from the transom is gradual and increasing based on an increase of a vertical displacement toward the smaller propeller draft.

4. The combination according to claim 1, wherein the oblique translation of the outboard engine is driven by the fastening devices that fasten the outboard engine to the transom with mechanical, electric, hydraulic, electro-hydraulic, electromechanical, or magnetic displacement actuators.

5. The combination according to claim 4, further comprising a control unit configured to drive the displacement actuators, so as to translate the outboard engine in the oblique direction away from the transom.

6. A method of governing a boat comprising one or more outboard engines, the method comprising:

causing at least one of the outboard engines to translate in an oblique direction by displacing the at least one of the outboard engines along a path having a first motion component of vertical orientation in a direction away from or in proximity to a waterline of the boat and a second motion component of horizontal or longitudinal orientation in a direction away from or in proximity to a transom of the boat, and by combining said first and said second motion component to produce the oblique direction, wherein causing the at least one of the outboard engines to translate in the oblique direction comprises causing fastening devices, which fasten the at least one outboard engine to said transom, to drive a translation of said outboard engine along said oblique direction, and wherein said fastening devices comprise a plurality of plates, one of the plates being fixed to the transom and at least one of the plates being movable, the plates being disposed to slide on one another, the at least one movable plate sliding on the fixed plate along a plane parallel to a sectional longitudinal plane of the boat or perpendicular to the sectional longitudinal plane of the boat.

7. The method according to claim 6, wherein the two first and the second motion components are perpendicular to one another.

8. The method according to claim 6, wherein the oblique direction occurs along a path corresponding to a straight line.

9. The method according to claim 6, wherein displacing the at least one of the outboard engines in the oblique direction away from the transom comprises displacing the at least one of the outboard engines gradually and increasingly based on an increase of a vertical displacement toward a smaller propeller draft.

10. The method according to claim 6, wherein displacing the at least one of the outboard engines comprises displacing in combination with a steering rotation of the at least one of the outboard engines, and with a trim inclination of the at least one of the outboard engines.

11. A propulsion assembly for a boat comprising:

one or more outboard engines;

one or more fastening devices that fasten the one or more outboard engines to a transom of the boat and that enable displacements of the one or more outboard engines along oblique predefined paths due to displacement actuators; and a drive system configured to drive the displacement actuators of the one or more fastening devices, the drive system comprising a drive member operable by a user and a control unit adapted to receive drive signals generated by the drive member and to transform the drive signals into power signals adapted to supply the displacement actuators correspondingly to the power signals generated by the drive member, wherein the control unit is programmed to drive the displacement actuators to translate the one or more outboard engines in an oblique direction away from the transom whenever said one or more outboard engines are translated vertically in a direction away from a waterline surface, with smaller propeller draft, by combining a vertical translation with a horizontal translation of the one or more outboard engines, and wherein the one or more fastening devices comprise a plurality of plates, one of the plates being fixed to the transom and at least one of the plates being movable, the plates being disposed to slide on one another, the at least one movable plate sliding on the fixed plate along a plane parallel to a sectional longitudinal plane of the boat or perpendicular to the sectional longitudinal plane of the boat.

12. The propulsion assembly according to claim 11, wherein the control unit is programmed to drive the displacement actuators to translate the one or more outboard engines in the oblique direction away from the transom, gradually and increasingly based on an increase of a vertical movement toward the smaller propeller draft.

* * * * *